US009539479B2

(12) United States Patent
Yashiki

(10) Patent No.: US 9,539,479 B2
(45) Date of Patent: Jan. 10, 2017

(54) GOLF CLUB SHAFT

(71) Applicant: DUNLOP SPORTS CO. LTD., Kobe-shi, Hyogo (JP)

(72) Inventor: Tatsuya Yashiki, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/429,061

(22) PCT Filed: Oct. 10, 2013

(86) PCT No.: PCT/JP2013/077552
§ 371 (c)(1),
(2) Date: Mar. 18, 2015

(87) PCT Pub. No.: WO2014/058002
PCT Pub. Date: Apr. 17, 2014

(65) Prior Publication Data

US 2015/0224375 A1 Aug. 13, 2015

(30) Foreign Application Priority Data

Oct. 10, 2012 (JP) ..... 2012-224809

(51) Int. Cl.
*A63B 53/10* (2015.01)

(52) U.S. Cl.
CPC ..... *A63B 53/10* (2013.01); *A63B 60/42* (2015.10); *A63B 2209/02* (2013.01); *A63B 2209/023* (2013.01); *A63B 2225/02* (2013.01)

(58) Field of Classification Search
CPC ... A63B 53/10; A63B 2209/023; A63B 60/42; A63B 2209/02; A63B 2225/02
See application file for complete search history.

(56) References Cited

U.S. PATENT DOCUMENTS 5,626,529 A * 5/1997 Roy ..... A63B 53/10 156/188
6,764,414 B2 * 7/2004 Kumamoto ..... A63B 53/10 473/297

(Continued)

FOREIGN PATENT DOCUMENTS

JP 10-329247 A 12/1998
JP 2000-325511 A 11/2000

(Continued)

OTHER PUBLICATIONS

International Search Report, issued in PCT/JP2013/077552, dated Jan. 7, 2014.

(Continued)

*Primary Examiner* — Stephen Blau
(74) *Attorney, Agent, or Firm* — Birch, Stewart, Kolsasch & Birch, LLP

(57) ABSTRACT

[Object] To provide a golf club shaft that can provide a moderate rigidity and enhance an impact strength.
[Solution] A shaft 6 includes full length layers s3, s4, s7, s8 and s9 provided wholly in a longitudinal direction of the shaft, and tip end partial layers s1, s2, s10, s11 and s12 provided on a tip end part of the shaft. The full length layers include bias layers s3 and s4 and straight layers s8 and s9. The tip end partial layer includes an inner glass fiber reinforced layer s1, and an outer low elastic carbon fiber reinforced layer s10 or an outer glass fiber reinforced layer s10 which is disposed outside the inner glass fiber reinforced layer s1. The low elastic carbon fiber has a tensile elastic modulus of 22 ton/mm$^2$ or less. In the shaft 6, a shaft weight in terms of 46 inches is 55 g or less.

6 Claims, 4 Drawing Sheets

(56) References Cited

U.S. PATENT DOCUMENTS

| | | | | |
|---|---|---|---|---|
| 6,863,623 | B2 * | 3/2005 | Oyama | A63B 53/10 473/319 |
| 6,872,151 | B2 * | 3/2005 | Oyama | A63B 53/10 473/319 |
| 6,875,127 | B2 * | 4/2005 | Hasegawa | A63B 53/10 473/319 |
| 6,926,617 | B2 * | 8/2005 | Oyama | A63B 53/10 473/319 |
| 7,500,922 | B2 * | 3/2009 | Takeuchi | A63B 53/10 473/319 |
| 7,736,245 | B2 * | 6/2010 | Hasegawa | A63B 53/10 473/319 |
| 8,206,238 | B2 * | 6/2012 | Kaneko | A63B 53/10 473/320 |
| 2004/0038744 | A1 | 2/2004 | Kumamoto | |
| 2010/0285897 | A1 * | 11/2010 | Takeuchi | A63B 53/10 473/319 |

FOREIGN PATENT DOCUMENTS

| | | | |
|---|---|---|---|
| JP | 3317619 | B2 | 8/2002 |
| JP | 2004-81230 | A | 3/2004 |
| JP | 4157357 | B2 | 10/2008 |
| JP | 2010-259694 | A | 11/2010 |

OTHER PUBLICATIONS

Written Opinion of the International Searching Authority, issued in PCT/JP2013/077552, dated Jan. 7, 2014.

* cited by examiner

GOLF CLUB SHAFT

TECHNICAL FIELD

The present invention relates to a golf club shaft.

BACKGROUND ART

A so-called carbon shaft has been known as a golf club shaft. A sheet winding process has been known as a method for manufacturing the carbon shaft. In the sheet winding process, a laminated constitution is obtained by winding a prepreg around a mandrel.

The prepreg includes a resin and a fiber. Many types of prepregs exist. A plurality of prepregs having different resin contents have been known. In the present application, the prepreg is also referred to as a prepreg sheet or a sheet.

In the sheet winding process, the type of a sheet, the disposal of the sheet, and the orientation of a fiber can be selected.

A shaft having a reinforced layer disposed on a thin diameter side portion is disclosed in Japanese Patent No. 3317619. The elastic modulus of a carbon fiber contained in the reinforced layer is 5 to 150 GPa.

A shaft including a middle elastic high strength carbon fiber reinforced resin sheet and a low elastic carbon fiber reinforced resin sheet to reinforce the TIP side of the shaft is disclosed in Japanese Patent Application Laid-Open No. 2004-81230. The reinforcing fiber of the low elastic carbon fiber reinforced resin sheet has a tensile elastic modulus of 5 to 10 ton/mm$^2$ and a compressive breaking strain of equal to or greater than 2.0%. The low elastic carbon fiber reinforced resin sheet is disposed on the outer layer side of the middle elastic high strength carbon fiber reinforced resin sheet.

In Japanese Patent No. 4157357, a composite prepreg having a PAN based carbon fiber and a pitch based low elastic fiber is used. In the composite prepreg, the elastic modulus of the PAN based carbon fiber is 200 GPa or greater and 500 GPa or less, and the elastic modulus of the pitch based low elastic fiber is 45 GPa or greater and 160 GPa or less.

Japanese Patent Application Laid-Open No. 10-329247 discloses a tubular body including an inner layer and an outer layer laminated outside the inner layer. The inner layer includes a reinforcing fiber and a resin. The outer layer includes a glass fiber and a resin. The ratio of the thickness of the outer layer to the total thickness of the tubular body is 5 to 35%.

CITATION LIST

Patent Literature

Patent Literature 1: Japanese Patent No. 3317619
Patent Literature 2: JP-A-2004-81230
Patent Literature 3: Japanese Patent No. 4157357
Patent Literature 4: JP-A-10-329247

SUMMARY OF INVENTION

Technical Problem

A shaft having a high impact strength is preferable. A moderate rigidity is also required for a shaft. A new laminated constitution that can achieve these demands has been found.

It is an object of the present invention to provide a golf club shaft that can provide a moderate rigidity and enhance an impact strength.

Solution to Problem

A golf club shaft of the present invention includes: full length layers disposed wholly in a longitudinal direction of the shaft; and tip end partial layers disposed on a tip end part of the shaft. The full length layers include a bias layer and a straight layer. The tip end partial layers include an inner glass fiber reinforced layer, and an outer low elastic carbon fiber reinforced layer or an outer glass fiber reinforced layer, which is disposed outside the inner glass fiber reinforced layer. The low elastic carbon fiber has a tensile elastic modulus of equal to or less than 22 ton/mm$^2$. The shaft has a shaft weight in terms of 46 inches of equal to or less than 55 g.

Preferably, the inner glass fiber reinforced layer is positioned inside the bias layer.

Preferably, the inner glass fiber reinforced layer is an innermost layer.

Preferably, the outer low elastic carbon fiber reinforced layer or the outer glass fiber reinforced layer is positioned outside all of the full length layers.

Preferably, the low elastic carbon fiber is a pitch based carbon fiber.

Preferably, the low elastic carbon fiber has a tensile elastic modulus of equal to or greater than 10 ton/mm$^2$.

Advantageous Effects of Invention

It is possible to obtain a golf club shaft that has a moderate rigidity and is excellent in strength.

DESCRIPTION OF EMBODIMENTS

Hereinafter, the present invention will be described in detail according to the preferred embodiments with appropriate references to the accompanying drawings.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer".

In the present application, an "inside" means an inside in a radial direction of a shaft. In the present application, an "outside" means an outside in the radial direction of the shaft.

Figure 1:
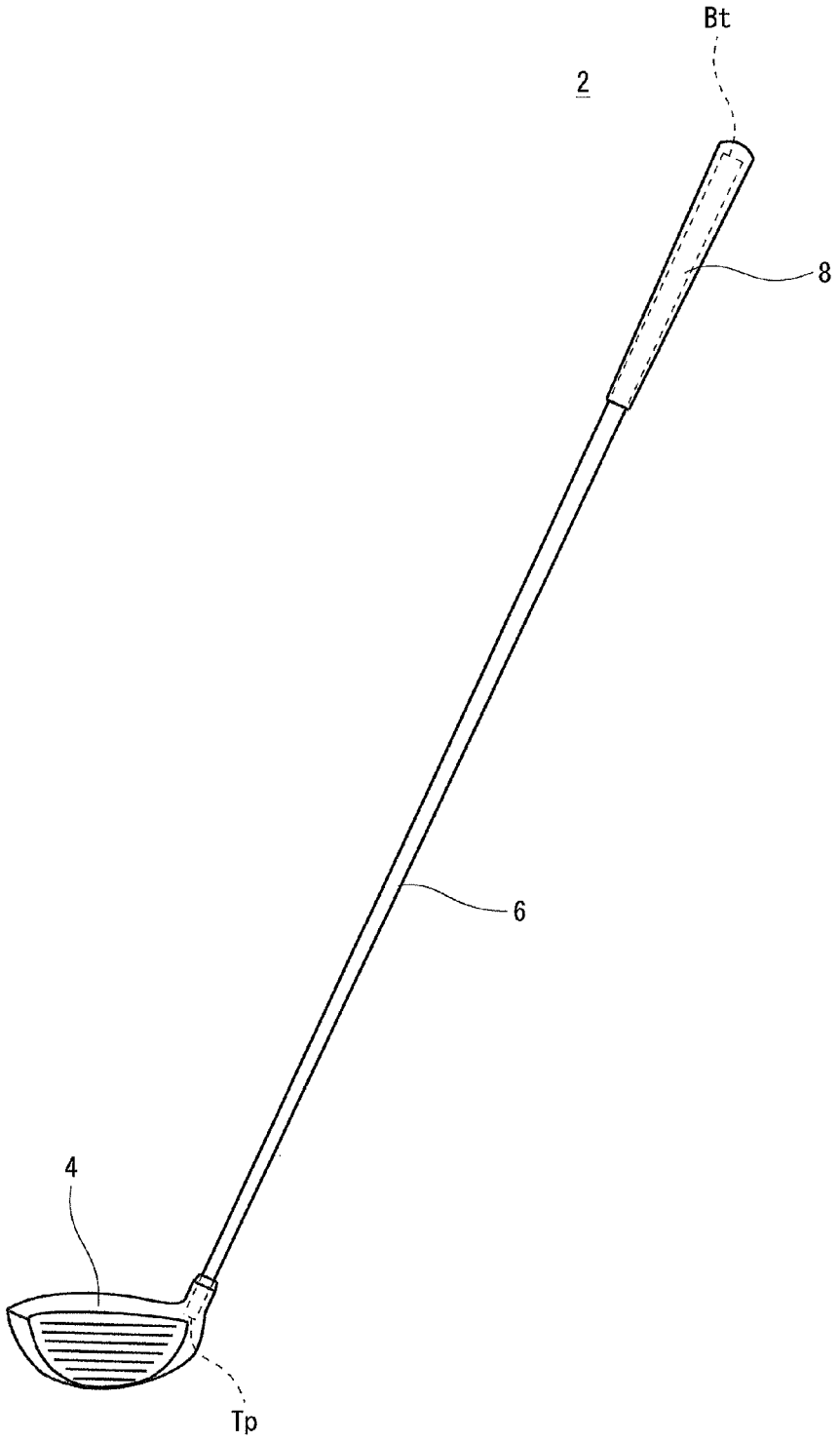
FIG. 1 shows a golf club including a shaft according to a first embodiment of the present invention.

FIG. 1 is an overall view of a golf club 2 including a golf club shaft 6 according to an embodiment of the present invention. The golf club 2 includes a head 4, a shaft 6, and a grip 8. The head 4 is provided on the tip end part of the shaft 6. The grip 8 is provided on the back end part of the shaft 6. The head 4 and the grip 8 are not limited. Examples of the head 4 include a wood type golf club head, an iron type golf club head, and a putter head. In the embodiment of FIG. 1, the wood type golf club head is used.

The shaft 6 includes a laminate of fiber reinforced resin layers. The shaft 6 is a tubular body. Although not shown in the drawings, the shaft 6 has a hollow structure. As shown in FIG. 1, the shaft 6 has a tip Tp and a butt Bt. The tip Tp is positioned in the head 4. The butt Bt is positioned in the grip 8.

The shaft 6 is a so-called carbon shaft. However, as described later, the shaft includes a layer containing a glass fiber as a reinforcing fiber.

The shaft 6 is preferably produced by curing the prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding process. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

Figure 2:
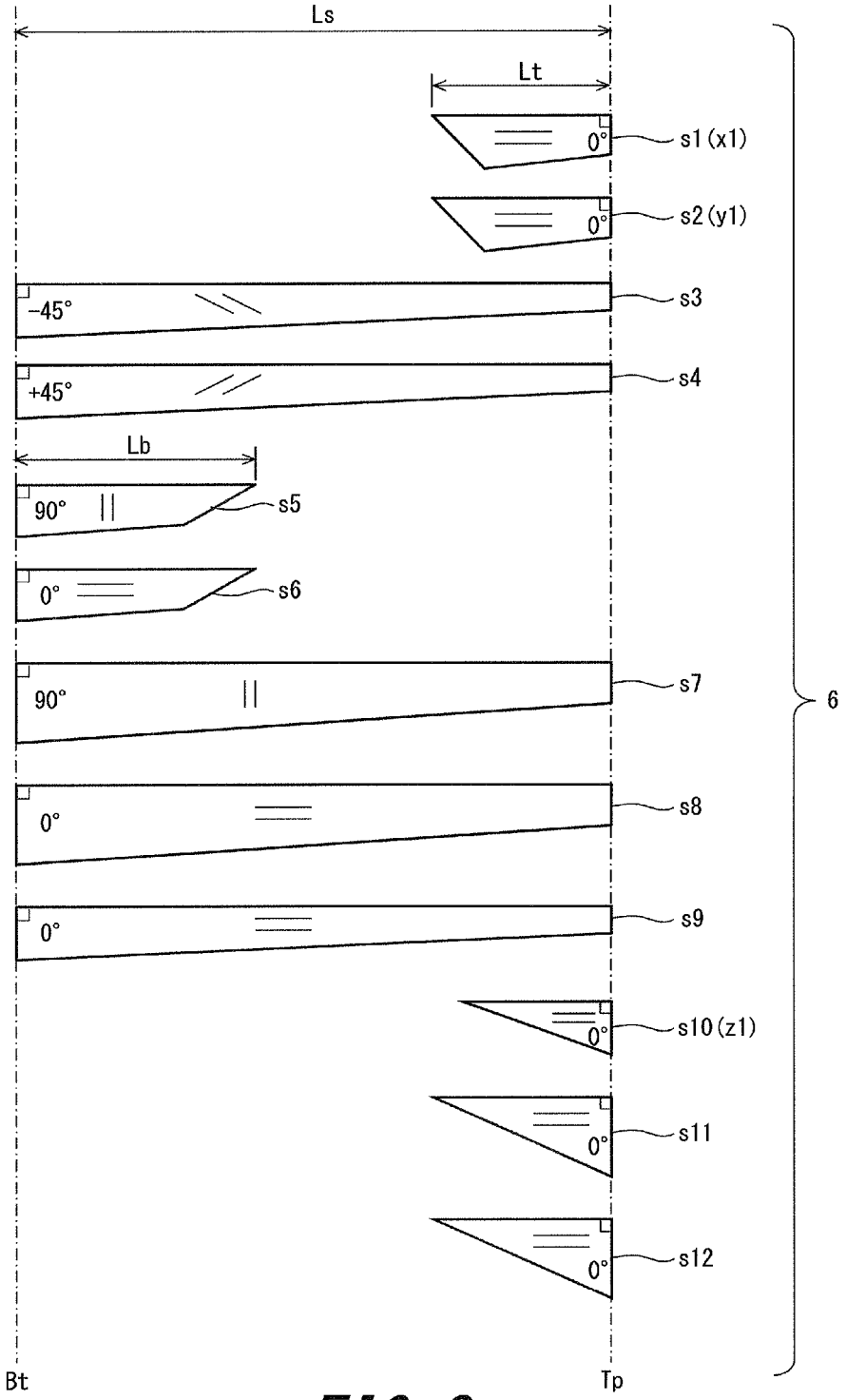
FIG. 2 is a developed view of the shaft according to the first embodiment.

FIG. 2 is a developed view (sheet constitution view) of the prepreg sheets constituting the shaft 6. The shaft 6 includes a plurality of sheets. In the embodiment of FIG. 2, the shaft 6 includes twelve sheets of a first sheet s1 to a 12th sheet s12. In the present application, the developed view shown in FIG. 2 or the like shows the sheets constituting the shaft in order from the radial inner side of the shaft. The sheets are wound in order from the sheet positioned on the uppermost side in the developed view. In the developed view of the present application, the horizontal direction of the figure coincides with the axial direction of the shaft. In the developed view of the present application, the right side of the figure is the tip Tp side of the shaft. In the developed view of the present application, the left side of the figure is the butt Bt side of the shaft.

The developed view of the present application shows not only the winding order of each of the sheets but also the arrangement of each of the sheets in the axial direction of the shaft. For example, in FIG. 2, one end of the sheet s1 is positioned on the tip Tp.

The shaft 6 has a straight layer and a bias layer. In the developed view of the present application, the orientation angle of the fiber is described. A sheet described as "0°" constitutes the straight layer. The sheet for the straight layer is also referred to as a straight sheet in the present application.

The straight layer is a layer in which the orientation of the fiber is substantially 0 degree to the longitudinal direction of the shaft (axial direction of the shaft). Usually, the orientation of the fiber is not to be completely parallel to the axis direction of the shaft due to an error or the like in winding. In the straight layer, an absolute angle θa of the fiber to the axis line of the shaft is equal to or less than 10 degrees. The absolute angle θa is an absolute value of an angle between the axis line of the shaft and the direction of the fiber. That is, the absolute angle θa of equal to or less than 10 degrees means that an angle Af between the direction of the fiber and the axis direction of the shaft is −10 degrees or greater and +10 degrees or less.

In the embodiment of FIG. 2, the straight sheets are the sheet s1, the sheet s2, the sheet s6, the sheet s8, the sheet s9, the sheet s10, the sheet s11 and the sheet s12. The straight layer is highly correlated with a flexural rigidity and a flexural strength.

The bias layer is provided mainly in order to enhance the torsional rigidity and torsional strength of the shaft.

Preferably, the bias layer includes a pair of sheets in which the orientations of the fibers are inclined in opposite directions to each other. Preferably, the bias layer includes a layer having the angle Af of −60 degrees or greater and −30 degrees or less and a layer having the angle Af of 30 degrees or greater and 60 degrees or less. That is, preferably, the absolute angle θa in the bias layer is 30 degrees or greater and 60 degrees or less.

In the shaft 6, the sheets constituting the bias layer are the sheet s3 and the sheet s4. In FIG. 2, the angle Af is described in each sheet. The plus (+) and minus (−) in the angle Af show that the fibers of bias sheets stacked to each other are inclined in opposite directions to each other. In the present application, the sheet for the bias layer is merely referred to as a bias sheet.

In the embodiment of FIG. 2, the angle of the sheet s3 is −45 degrees and the angle of the sheet s4 is +45 degrees. However, conversely, it should be appreciated that the angle of the sheet s3 may be +45 degrees and the angle of the sheet s4 may be −45 degrees.

A hoop layer is a layer in which the fiber is oriented along the circumferential direction of the shaft. Preferably, the absolute angle θa in the hoop layer is substantially 90 degrees to the axis line of the shaft. However, the orientation of the fiber to the axis direction of the shaft may not be completely set to 90 degrees due to an error or the like in winding. Normally, in the hoop layer, the absolute angle θa is equal to or greater 80 degrees. The upper limit value of the absolute angle θa is 90 degrees.

The hoop layer contributes to the increase in the crushing rigidity and crushing strength of the shaft. The crushing rigidity is a rigidity to a force crushing the shaft toward the inside of the radial direction thereof. The crushing strength is a strength to a force crushing the shaft toward the inside of the radial direction thereof. The crushing strength can also be involved with the flexural strength. Crushing deformation can be generated with flexural deformation. In a particularly thin lightweight shaft, this interlocking property is large. The increase in the crushing strength can also cause the increase in the flexural strength.

In the embodiment of FIG. 2, the prepreg sheets for the hoop layer are the sheet s5 and the sheet s7. In the present application, the prepreg sheet for the hoop layer is also referred to as a hoop sheet.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semicured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is first peeled. Next, the winding start edge part is applied on the wound object, and the mold release paper is then peeled. Thus, the resin film is first peeled, and after the winding start edge part is applied on the wound object, the mold release paper is peeled. The procedure suppresses the wrinkles and winding fault of the sheet. This is because the sheet on which the mold release paper is applied is supported by the mold release paper, and causes less wrinkle. The mold release paper has flexural rigidity higher than that of the resin film.

A united sheet is used in the embodiment of FIG. 2. The united sheet is formed by stacking two sheets.

The three united sheets are formed in the embodiment of FIG. 2. A bias united sheet obtained by stacking the sheet s3 and the sheet s4 is formed. The two sheets s3 and s4 are used as the bias layer. The orientation angles of the fibers of the sheets s3 and s4 are opposite to each other. The directivity of a torsional direction can be eliminated by the set of the sheets s3 and s4. For this reason, a bias united sheet is used. A hoop straight united sheet obtained by stacking the sheet s5 and the sheet s6 is formed. A hoop straight united sheet obtained by stacking the sheet s7 and the sheet s8 is formed. When the fiber is bended along the circumferential direction of the shaft, the rigidity of the fiber generates resistance to the bending. Because of the resistance, the prepreg tends to be torn along a fiber direction. Thus, a hoop sheet is difficult to wind solely. The united sheets are formed in order to prevent the tear.

As described above, in the present application, the sheet and the layer are classified by the orientation angle of the fiber. In addition, in the present application, the sheet and the layer are classified by the length of the shaft in the longitudinal direction.

In the present application, a layer disposed wholly in the longitudinal direction of the shaft is referred to as a full length layer. In the present application, a sheet disposed wholly in the longitudinal direction of the shaft is referred to as a full length sheet. The wound full length sheet forms the full length layer.

Meanwhile, in the present application, a layer disposed partially in the longitudinal direction of the shaft is referred to as a partial layer. In the present application, a sheet disposed partially in the longitudinal direction of the shaft is referred to as a partial sheet. The wound partial sheet forms the partial layer.

In the present application, the full length layer which is the bias layer is referred to as a full length bias layer. In the present application, the full length layer which is the straight layer is referred to as a full length straight layer. In the present application, the full length layer which is the hoop layer is referred to as a full length hoop layer.

In the present application, the partial layer which is the bias layer is referred to as a partial bias layer. In the present application, the partial layer which is the straight layer is referred to as a partial straight layer. In the present application, the partial layer which is the hoop layer is referred to as a partial hoop layer.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the stacking process to produce the united sheets.

In the stacking process, heating or a press may be used. More preferably, the heating and the press are used in combination. In a winding process to be described later, the deviation of the sheet may occur during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to produce the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of the thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

The sheets to be stacked are wound in a state of the united sheet.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wound around the outer peripheral surface of the winding body in the tape wrapping process. The tape is also referred to as a wrapping tape. The wrapping tape is wound while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both End Parts

The both end parts of the cured laminate are cut in the process. The cutting flattens the end face of the tip Tp and the end face of the butt Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate.

(9) Coating Process

The cured laminate after the polishing process is subjected to coating.

In the present application, the same reference numeral is used in the layer and the sheet. For example, a layer formed by the sheet s1 is the layer s1. The shaft 6 includes the first layer s1 to the 12th layer s12. The layer number of each layer is not limited to 1. The number of windings (ply number) of each layer may be less than 1, and may be greater than 1.

In the shaft 6, the full length layers are the layer s3, the layer s4, the layer s7, the layer s8 and the layer s9. The layer s3 and the layer s4 are the full length bias layers. The layer s7 is the full length hoop layer. The layer s8 and the layer s9 are the full length straight layers.

In the shaft 6, the partial layers are the layer s1, the layer s2, the layer s5, the layer s6, the layer s10, the layer s11 and the layer s12. The layer s1, the layer s2, the layer s10, the layer s11 and the layer s12 are the partial straight layers. The layer s5 is the partial hoop layer.

The layer s1, the layer s2, the layer s10, the layer s11 and the layer s12 are disposed on the tip end part of the shaft 6. These layers are also referred to as tip end partial layers. A distance between the back end of the tip end partial layer and the tip end Tp of the shaft 6 is represented by a double-pointed arrow Lt in FIG. 2. In respect of reinforcing the tip end part while suppressing a shaft weight, the distance Lt is preferably equal to or less than 400 mm, more preferably equal to or less than 350 mm, and still more preferably equal to or less than 300 mm.

The layer s1 and the layer s2 are straight tip end partial layers. These partial layers s1 and s2 are positioned inside the full length bias layers s3 and s4. The layer s10, the layer s11 and the layer s12 are straight tip end partial layers. These partial layers s10, s11 and s12 are positioned outside the full length bias layers s3 and s4. These partial layers s10, s11 and s12 are positioned outside all of the full length layers.

The layer s5 and the layer s6 are disposed on the back end part of the shaft 6. These layers are also referred to as butt end partial layers. A distance between the tip of the butt end partial layer and the butt end Bt of the shaft 6 is represented by a double-pointed arrow Lb in FIG. 2. In respect of reinforcing the back end part while suppressing the shaft weight, the distance Lb is preferably equal to or less than 500 mm, more preferably equal to or less than 450 mm, and still more preferably equal to or less than 400 mm.

The layer s5 is a hoop butt end partial layer. The partial layer s5 is positioned outside the full length bias layers s3 and s4. The partial layer s5 is positioned inside the full length straight layers s8 and s9.

The layer s6 is a straight butt end partial layer. The partial layer s6 is positioned outside the full length bias layers s3 and s4. The partial layer s6 is positioned inside the full length straight layers s8 and s9.

In the embodiment, a glass fiber reinforced prepreg is used. The glass fiber reinforced prepreg is a prepreg, the reinforcing fiber of which is a glass fiber. In the glass fiber reinforced prepreg of the embodiment, the fiber is oriented substantially in one direction. That is, the glass fiber reinforced prepreg is a UD prepreg. A glass fiber reinforced prepreg other than the UD prepreg may be used. For example, glass fibers contained in the prepreg sheet may be woven.

In the embodiment, a prepreg other than the glass fiber reinforced prepreg is a carbon fiber reinforced prepreg. Examples of the carbon fiber include a PAN based carbon fiber and a pitch based carbon fiber.

In the embodiment of FIG. 2, the glass fiber reinforced prepreg is used for a straight tip end partial layer. In the embodiment of FIG. 2, the innermost straight tip end partial layer x1 is a glass fiber reinforced layer. In the embodiment, the tip end partial layer x1 is formed by a glass fiber reinforced prepreg. The tip end partial layer x1 is disposed inside the bias layers s3 and s4. The innermost straight tip end partial layer x1 is an inner glass fiber reinforced layer.

In the embodiment of FIG. 2, a straight tip end partial layer y1 is provided outside the tip end partial layer x1. A carbon fiber reinforced prepreg is used for the tip end partial layer y1. The tip end partial layer y1 is disposed inside the bias layers s3 and s4. The tip end partial layer y1 is positioned outside the tip end partial layer x1. The tip end partial layer y1 is positioned between the tip end partial layer x1 and the bias layers s3, s4.

The shape of the mandrel corresponds to the thickness of the tip end partial layers s1 and s2 positioned inside the bias layers s3 and s4. At the position where the tip end partial layers s1 and s2 are wound, the mandrel is made thin. The mandrel is designed so that the outer shape of the mandrel with the tip end partial layers s1 and s2 in a state where the tip end partial layers s1 and s2 are wound is a simple taper shape. Therefore, the generation of wrinkles caused by the presence of the tip end partial layers s1 and s2 is suppressed.

The layer s9 is the full length straight layer. The tip end partial layers s10, s11 and s12 are provided outside of the layer s9.

In the embodiment of FIG. 2, the tip end partial layer s10 is a tip end partial layer z1 which is positioned outside the bias layers s3 and s4, and is not an outermost layer. Preferably, the tip end partial layer z1 is positioned outside all of the full length layers. The tip end partial layers s11 and s12 are disposed outside the tip end partial layer z1. These layers s11 and s12 cover the tip end partial layer z1. The tip end partial layer z1 is never polished because of the presence of the layer s11 and the layer s12.

In the embodiment, the reinforcing fiber of the tip end partial layer z1 is a pitch based carbon fiber.

The pitch based carbon fiber contained in the tip end partial layer z1 is a low elastic carbon fiber. The low elastic carbon fiber is a carbon fiber having a tensile elastic modulus of equal to or less than 22 ton/mm$^2$. The tip end partial layer z1 is the outer low elastic carbon fiber reinforced layer.

Thus, in the shaft 6, the tip end partial layers contain an inner glass fiber reinforced layer s1 and an outer low elastic carbon fiber reinforced layer s10 disposed outside the inner glass fiber reinforced layer s1. The tensile elastic modulus of the low elastic carbon fiber contained in the layer s10 is equal to or less than 22 ton/mm$^2$. The layer s10 may be a glass fiber reinforced layer.

The inner layer of the shaft is close to the neutral axis of the section of the shaft (the axis line of the shaft). Therefore, a tensile stress and a compressive stress which are generated when the ball is hit in the inner layer of the shaft are smaller than those in the outer layer of the shaft. Meanwhile, it became clear that an impact-absorbing energy is improved by disposing the glass fiber reinforced layer from test results to be described later. From the finding, the inside disposal of the glass fiber reinforced layer s1 is effective in improvement in the impact-absorbing energy (effect A).

In the shaft 6, the inner glass fiber reinforced layer s1 is positioned inside the bias layers s3 and s4. Therefore, the effect A can be improved.

In the shaft 6, the inner glass fiber reinforced layer s1 is the innermost layer. Therefore, the distance between the layer s1 and the neutral axis is the shortest, which can further improve the effect A.

The elastic modulus of the glass fiber is about 7 to 8 ton/mm$^2$, and comparatively low. The reduction of the rigidity can be suppressed by disposing the low elastic glass fiber in the inner layer. That is, in the embodiment, an impact strength is improved by utilizing the inner layer in which the contribution degree of the flexural rigidity is low. Therefore, the impact strength can be improved while the flexural rigidity is secured.

The outer layer of the shaft is far from the neutral axis of the section of the shaft (the axis line of the shaft). Therefore, a tensile stress and a compressive stress which are generated when the ball is hit in the outer layer of the shaft are greater than those in the inner layer of the shaft. It is considered that shaft breakage is caused by compressive breakage in particular. The low elastic carbon fiber has an excellent strength to the compressive breakage than that of a glass fiber. For this reason, a strength to bending can be improved by providing the outer low elastic carbon fiber reinforced layer s10 for the outer layer (effect B).

In the shaft 6, the outer low elastic carbon fiber reinforced layer s10 is positioned outside the inner glass fiber reinforced layer s1. Therefore, the effect B can be improved.

In the shaft 6, the outer low elastic carbon fiber reinforced layer s10 is position outside all of the full length layers (layers s3, s4, s7, s8 and s9). Therefore, the effect B can be further improved.

In the shaft 6, the inner glass fiber reinforced layer s1 is positioned inside all of the full length layers (layers s3, s4, s7, s8 and s9). Meanwhile, the outer low elastic carbon fiber reinforced layer s10 is positioned outside all of the full length layers (layers s3, s4, s7, s8 and s9). For this reason, a radial direction distance between the layer s1 and the layer s10 is large. Therefore, the effect A and the effect B can be synergistically exhibited.

In respect of enhancing the synergistic effect of the effect A and effect B, a radial direction distance dl between the inner glass fiber reinforced layer s1 and the outer low elastic carbon fiber reinforced layer s10 is preferably equal to or greater than 1.0 mm, more preferably equal to or greater than 1.2 mm, and still more preferably equal to or greater than 1.4 mm. Since the diameter of the tip end of the shaft is restricted, the distance dl is usually equal to or less than 1.8 mm.

The low elastic carbon fiber contained in the layer s10 is a pitch based carbon fiber. The low elastic carbon fiber contained in the layer s10 has a tensile elastic modulus lower than that of a carbon fiber contained in the full length layers. Displacement at breaking can be increased by the low elastic carbon fiber. Therefore, it is possible to increase an impact-absorbing energy.

The low elastic carbon fiber contained in the layer s10 has a tensile elastic modulus of equal to or greater than 10 ton/mm$^2$. The excessive deterioration of flexural rigidity can be suppressed by the tensile elastic modulus. Therefore, both the securement of the flexural rigidity and the improvement of the impact strength can be effectively achieved.

As mentioned above, the elastic modulus of a glass fiber is about equal to or greater than 7 to 8 ton/mm$^2$. In respect of suppressing the excessive deterioration of the flexural rigidity, the layer s10 is preferably a low elastic carbon fiber reinforced layer in which the elastic modulus of the carbon fiber is higher than that of the glass fiber. Since the carbon fiber has a degree of freedom for setting a tensile elastic modulus, the tensile elastic modulus can be set to equal to or greater than 10 ton/mm$^2$, for example.

The layer s10 may be a glass fiber reinforced layer. Meanwhile, the specific gravity of the glass fiber is greater than that of the carbon fiber. In respect of the weight saving of the shaft, the layer s10 is preferably the law elastic carbon fiber reinforced layer.

In respect of material costs, the outer glass fiber reinforced layer is more preferable than the outer low elastic carbon fiber reinforced layer.

In respect of the impact-absorbing energy, the layer s10 may be the outer glass fiber reinforced layer. Because of its large compressive breaking strain, the glass fiber is effective in improving the impact-absorbing energy. Improvement of the impact-absorbing energy is achieved by applying the glass fiber reinforced layer to both the inner layer and the outer layer.

The tip end partial layers s11 and s12 are provided outside the layer s10. The layer s12 is an outermost tip end partial layer s12. The layer s10 is covered with the outermost tip end partial layer s12. The reinforcing fiber of the outermost tip end partial layer s12 is a carbon fiber. The reinforcing fiber of the outermost tip end partial layer s12 is a PAN based carbon fiber. The outermost tip end partial layer s12 prevents the layer s10 from being polished thereby to protect the layer s10. The outermost tip end partial layer s12 secures the flexural rigidity of the tip end part of the shaft.

The smaller weight of the shaft makes it difficult to achieve both the rigidity and the strength. For this reason, the embodiment is particularly effective for a lightweight shaft. In this respect, the shaft 6 has a shaft weight Mt in terms of 46 inches of preferably equal to or less than 55 g, and more preferably equal to or less than 52 g. The shaft weight Mt (g) in terms of 46 inches is calculated by multiplying a weight Mx (g) per 1 inch by 46. The weight Mx (g) is obtained by dividing a shaft weight (g) by a shaft length (inch). In respect of the strength of the shaft, the shaft weight Mt is preferably equal to or greater than 35 g, and more preferably equal to or greater than 38 g.

In respect of an impact-absorbing effect, a tensile elastic modulus E1 of the reinforcing fiber contained in the outer low elastic carbon fiber reinforced layer is preferably equal to or less than 22 ton/mm$^2$, and more preferably equal to or less than 20 ton/mm$^2$. When an excessive deformation occurs, other layer can be broken before generating impact absorbing. In this respect, the tensile elastic modulus E1 is preferably equal to or greater than 4 ton/mm$^2$, more preferably equal to or greater than 5 ton/mm$^2$, still more preferably equal to or greater than 8 ton/mm$^2$, and yet still more preferably equal to or greater than 10 ton/mm$^2$.

An epoxy resin, a thermosetting resin other than the epoxy resin, and a thermoplastic resin or the like may be used as the matrix resin of the prepreg sheet. In respect of the strength of the shaft, the matrix resin is preferably the epoxy resin.

EXAMPLES

Hereinafter, the effects of the present invention will be clarified by examples. However, the present invention should not be interpreted in a limited way based on the description of examples.

Example 1

A shaft having the same laminated constitution as that of the shaft 6 was produced. That is, a shaft having the sheet constitution shown in FIG. 2 was produced. A manufacturing method is the same as that of the shaft 6. Trade names of prepregs used for sheets are as follows. Sheets other than the sheet s1 and the sheet s10 are PAN based carbon fiber reinforced prepregs.

sheet s1: GE352H-160S (manufactured by Mitsubishi Rayon Co., Ltd.)

sheet s2: TR350C-100S (manufactured by Mitsubishi Rayon Co., Ltd.)

sheet s3: HRX350C-075S (manufactured by Mitsubishi Rayon Co., Ltd.)

sheet s4: HRX350C-075S (manufactured by Mitsubishi Rayon Co., Ltd.)

sheet s5: 805S-3 (manufactured by Toray Industries, Inc.)

sheet s6: E1026A-09N (manufactured by Nippon Graphite Fiber Corporation)

sheet s7: 805S-3 (manufactured by Toray Industries, Inc.)

sheet s8: 2256S-12 (manufactured by Toray Industries, Inc.)

sheet s9: 2256S-10 (manufactured by Toray Industries, Inc.)

sheet s10: E1026A-09N (manufactured by Nippon Graphite Fiber Corporation)

sheet s11: TR350C-100S (manufactured by Mitsubishi Rayon Co., Ltd.)

sheet s12: TR350C-100S (manufactured by Mitsubishi Rayon Co., Ltd.)

The trade name "GE352H-160S" is a glass fiber reinforced prepreg. A glass fiber is E glass, and the tensile elastic modulus of the glass fiber is 75 GPa (7.65 ton/mm$^2$).

The trade name "E1026A-09N" is a pitch based carbon fiber reinforced prepreg. The part number of the pitch based carbon fiber is "XN-10", and the tensile elastic modulus thereof is 110 GPa (11.2 ton/mm$^2$)

The evaluation results of example 1 are shown in Table 1 below. In example 1, the full length Ls of the shaft was 1168 mm, and the shaft weight Mt was 46 g. A distance Lt (See FIG. 2) at the sheet s1 was set to 200 mm, and a distance Lt at the sheet s10 was set to 180 mm.

Example 2 and Comparative Examples 1 to 6

Shafts of example 2 and comparative examples 1 to 6 were obtained in the same manner as in the example 1 except that sheets shown in Table 1 were used for the layers s1, s2 and s10. The evaluation results of these shafts are shown in Table 1 below. The trade name "E1026A-14N" is a pitch based carbon fiber reinforced prepreg manufactured by Nippon Graphite Fiber Corporation. The part number of the pitch based carbon fiber is "XN-10", and the tensile elastic modulus thereof is 110 GPa (11.2 ton/mm$^2$).

As shown in Table 1, the inner glass fiber reinforced layer s1 and the outer low elastic carbon fiber reinforced layer s10 were used in example 1. The inner glass fiber reinforced layer s1 and the outer glass fiber reinforced layer s10 were used in example 2.

TABLE 1

Specifications and evaluation results of examples and comparative examples

| | | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|---|
| laminated layer | layer s1 | GE352H-160S | GE352H-160S | GE352H-160S | E1026A-14N | E1026A-14N | TR350C-100S | TR350C-100S | TR350C-100S |
| | layer s2 | TR350C-100S | TR350C-100S | TR350C-100S | TR350C-100S | TR350C-100S | TR350C-100S | TR350C-100S | TR350C-100S |
| | layer s10 | E1026A-09N | GE352H-160S | TR350C-100S | GE352H-160S | E1026A-09N | E1026A-09N | GE352H-160S | TR350C-100S |
| impact-absorbing energy (J) | | 3.61 | 3.63 | 3.43 | 3.47 | 3.44 | 3.35 | 3.38 | 3.28 |

[Method for Measuring Impact-Absorbing Energy]

Figure 3:
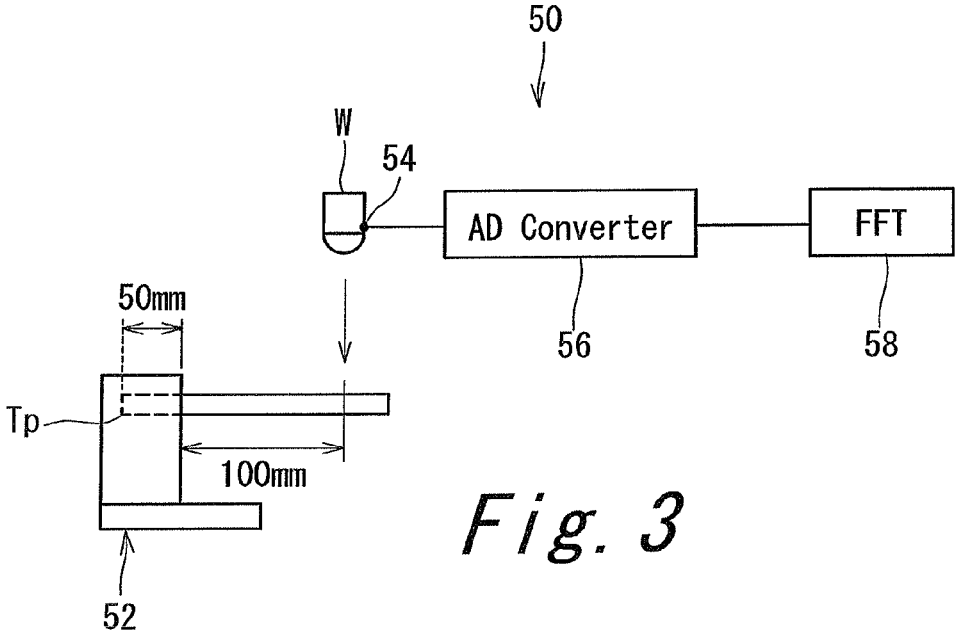
FIG. 3 is a schematic view showing a method for measuring an impact-absorbing energy.

FIG. 3 shows a method for measuring an impact-absorbing energy. An impact test was conducted by a cantilever bending method. A drop weight impact tester (IITM-18) manufactured by Yonekura MFG Co., Ltd. was used as a measuring apparatus 50. A tip end part between a tip end Tp of the shaft and a position separated by 50 mm from the tip end Tp was fixed to a fixing jig 52. A weight W of 600 g was dropped to the shaft at a position separated by 100 mm from the fixed end and the weight W was dropped from the upper side at 1500 mm above the position. An accelerometer 54 was attached to the weight W. The accelerometer 54 was connected to an FFT analyzer 58 through an AD converter 56. A measurement wave profile was obtained by FFT treatment. Displacement D and an impact flexural load L were measured by the measurement to calculate an impact-absorbing energy before breakage started.

Figure 4:
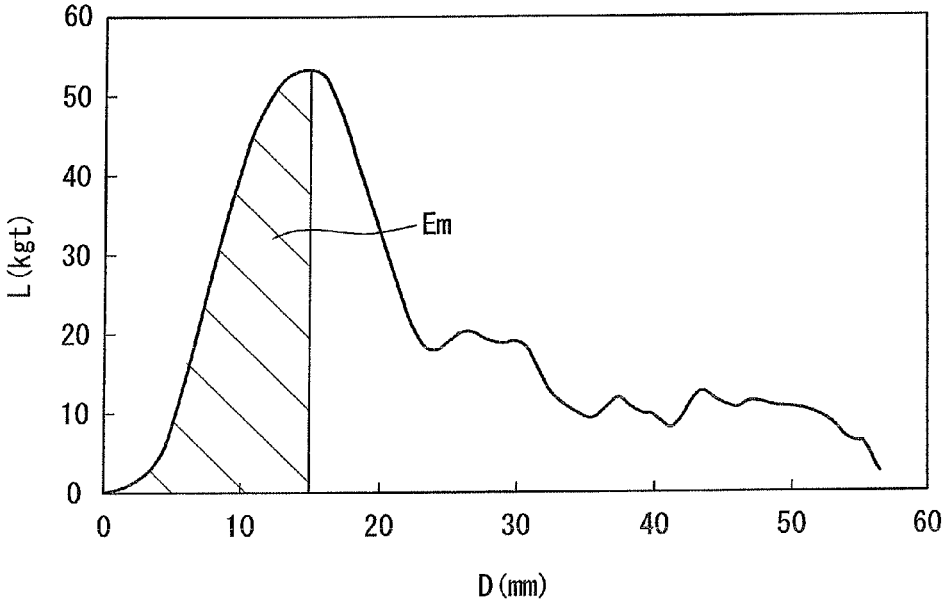
FIG. 4 is a graph showing an example of a wave profile obtained when the impact-absorbing energy is measured.

FIG. 4 is an example of the measured wave profile. The wave profile is a graph showing the relationship between the displacement D (mm) and the impact flexural load L (kgf). In the graph of FIG. 5, the area of a portion represented by hatching represents an impact-absorbing energy Em (J).

[Evaluation of Hitting Feeling]

A 460 cc driver head and a grip were attached to each shaft to obtain 46-inch golf clubs. Ten golf players having a handicap of 10 or less actually hit balls with the clubs and evaluated hitting feelings of those. Sensuous evaluation was made on a scale of one to five. The higher the score is, the higher the evaluation is. The average scores of the ten golf players are as follows.

Example 1: 4.4 points
Example 2: 4.5 points
Comparative Example 1: 4.0 points
Comparative Example 2: 4.3 points
Comparative Example 3: 4.2 points
Comparative Example 4: 3.5 points
Comparative Example 5: 3.3 points
Comparative Example 6: 3.6 points According to a golf player who gave a high score to example 1, the opinion was voiced that the hitting feeling of example 1 is excellent particularly in "not only having a soft hitting feeling but also having a bouncing feeling". It is considered that this is because not only is the impact-absorbing effect excellent but the flexural rigidity of the tip part is also secured. Meanwhile, according to a golf player who gave a high core to example 2, the opinion was voiced that the hitting feeling of example 2 is excellent particularly in "having a soft hitting feeling and having no numbness in hands". It is considered that this is because the impact-absorbing effect is exhibited to the utmost.

Thus, the examples are highly evaluated as compared with the comparative examples. The advantages of the present invention are apparent.

INDUSTRIAL APPLICABILITY

The method described above can be applied to golf club shafts.

DESCRIPTION OF THE REFERENCE CHARACTERS

2 . . . golf club
4 . . . head
6 . . . shaft
8 . . . grip
s1 to s12 . . . prepreg sheet (layer)
s1 . . . inner glass fiber reinforced layer
s10 . . . outer low elastic carbon fiber reinforced layer (or outer glass fiber reinforced layer)
Tp . . . tip end of the shaft
Bt . . . butt end of the shaft

The invention claimed is:

1. A golf club shaft which has a tip end and a butt end, said shaft comprising:

full length layers disposed wholly in a longitudinal direction of the shaft; and tip end partial layers disposed on the tip end of the shaft, wherein the full length layers include a bias layer and a straight layer; and the tip end partial layers include an inner glass fiber reinforced layer, and an outer low elastic carbon fiber reinforced layer which is disposed outside the inner glass fiber reinforced layer;

wherein the reinforcing fiber of the outer low elastic carbon fiber reinforced layer is a pitch-based carbon fiber; the low elastic carbon fiber has a tensile elastic modulus of equal to or less than 22 ton/mm$^2$; and the outer low elastic carbon fiber reinforced layer is not an outermost layer; and wherein a weight of the shaft is equal to or less than 55/46 grams per inch of shaft length.

2. The golf club shaft according to claim 1, wherein the inner glass fiber reinforced layer is positioned inside the bias layer.

3. The golf club shaft according to claim 1, wherein the inner glass fiber reinforced layer is an innermost layer.

4. The golf club shaft according to claim 1, wherein the outer low elastic carbon fiber reinforced layer is positioned outside all of the full length layers.

5. The golf club shaft according to claim 1, wherein the low elastic carbon fiber is a pitch based carbon fiber.

6. The golf club shaft according to claim 1, wherein the low elastic carbon fiber has a tensile elastic modulus of equal to or greater than 10 ton/mm$^2$.

* * * * *